US009164465B2

(12) United States Patent
Mori et al.

(10) Patent No.: US 9,164,465 B2
(45) Date of Patent: Oct. 20, 2015

(54) IMAGE FORMING APPARATUS

(71) Applicant: Konica Minolta, Inc., Tokyo (JP)

(72) Inventors: Tomohide Mori, Tokyo (JP); Yoshitada Karimai, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/465,227

(22) Filed: Aug. 21, 2014

(65) Prior Publication Data

US 2015/0055970 A1 Feb. 26, 2015

(30) Foreign Application Priority Data

Aug. 23, 2013 (JP) ..... 2013-173349

(51) Int. Cl.
*G03G 21/00* (2006.01)

(52) U.S. Cl.
CPC ..... *G03G 21/0011* (2013.01); *G03G 21/0076* (2013.01)

(58) Field of Classification Search
CPC combination set(s) only.
See application file for complete search history.

(56) References Cited

U.S. PATENT DOCUMENTS

2012/0134700 A1* 5/2012 Yamaki et al. ..... 399/71

FOREIGN PATENT DOCUMENTS

JP 2007171395 A 7/2007

* cited by examiner

*Primary Examiner* — Clayton E Laballe
*Assistant Examiner* — Jas Sanghera
(74) *Attorney, Agent, or Firm* — Cantor Colburn LLP

(57) ABSTRACT

An image forming apparatus includes: an image bearing member configured to be forwardly and reversely rotatable; a cleaning blade configured to make contact with the image bearing member and scrape toner remaining on the image bearing member; a toner retention section defined on an upstream side of the cleaning blade in a forward rotational direction of the image bearing member, the toner retention section being configured to retain toner scraped by the cleaning blade; a driving section configured to rotationally drive the image bearing member; and a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed.

8 Claims, 6 Drawing Sheets

IMAGE FORMING APPARATUS

CROSS REFERENCE TO RELATED APPLICATIONS

This application is entitled and claims the benefit of Japanese Patent Application No. 2013-173349, filed on Aug. 23, 2013, the disclosure of which including the specification, drawings and abstract is incorporated herein by reference in its entirety.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

For example, in an image forming apparatus of an intermediate transfer belt type, a toner image formed on a photoconductor is transferred to an intermediate transfer belt, and the toner image transferred to the intermediate transfer belt is transferred to a sheet.

In this process, the toner is not completely transferred to the sheet and remains on the surface of the intermediate transfer belt. The remaining toner hinders subsequent image forming, and causes a problem that a favorable transfer image cannot be obtained.

In the above-mentioned cleaning apparatus, a cleaning blade is brought into pressure contact with the surface of the intermediate transfer belt to remove the toner remaining on the intermediate transfer belt. As the image formation process is continuously performed, foreign matter 230 (mainly, aggregates of paper dust and the like) is gathered and gradually accumulated at a part (hereinafter referred to as "blade edge 212") where cleaning blade 210 makes pressure contact with intermediate transfer belt 220, as illustrated in FIG. 1. This leads to a state where foreign matter 230 is sandwiched between cleaning blade 210 and intermediate transfer belt 220, or in other words, a state where blade edge 212 of cleaning blade 210 is separated from the surface of intermediate transfer belt 220. When the state where blade edge 212 is separated from the surface of intermediate transfer belt 220 is continued, part 250 (hereinafter referred to as "toner 250") of toner 240 remaining on intermediate transfer belt 220 may pass through a space between cleaning blade 210 and intermediate transfer belt 220 where foreign matter 230 does not exist, in the rotational axis direction of intermediate transfer belt 220.

When toner 250 passes through the space between cleaning blade 210 and intermediate transfer belt 220, that is, when a cleaning defect is caused in the above-mentioned manner, remaining toner 250 is transferred onto the image formed by the next image formation process and becomes image noise in a black streak form. Thus, image noise is caused.

In order to prevent such a cleaning defect, conventionally, there has been proposed a technique in which an intermediate transfer belt is reversed to remove the foreign matter sandwiched between a cleaning blade and an intermediate transfer belt (see, for example, Japanese Patent Application Laid-Open No. 2007-171395).

However, with the conventional technique in which the intermediate transfer belt is reversed, when the foreign matter once removed from the space between the cleaning blade and the intermediate transfer belt again enters the blade edge, the foreign matter is sometimes gathered at the blade edge and sandwiched between the cleaning blade and the intermediate transfer belt. As such, the conventional techniques could not have completely eliminated the risk that toner pass through the space between the cleaning blade and the intermediate transfer belt, that is, the risk that cleaning defect is caused.

SUMMARY OF THE INVENTION

An object of the present invention is to provide an image forming apparatus which can surely prevent a cleaning defect.

To achieve the abovementioned object, an image forming apparatus reflecting one aspect of the present invention includes: an image bearing member configured to be forwardly and reversely rotatable; a cleaning blade configured to make contact with the image bearing member and scrape toner remaining on the image bearing member; a toner retention section defined on an upstream side of the cleaning blade in a forward rotational direction of the image bearing member, the toner retention section being configured to retain the toner scraped by the cleaning blade; a driving section configured to rotationally drive the image bearing member; and a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed.

Desirably, the image forming apparatus further includes a toner supplying section configured to supply toner to the image bearing member, wherein the control section controls the toner supplying section such that the upper surface position of the toner retained in the toner retention section is set to a predetermined upper surface position.

Desirably, the image forming apparatus further includes a detection section configured to detect the upper surface position of the toner retained in the toner retention section, wherein the control section computes a distance to the upper surface position on the basis of a detection result of the detection section.

Desirably, the image forming apparatus further includes a toner retention roller configured to make contact with the image bearing member, the toner retention roller defining the toner retention section together with the image bearing member, wherein the control section reversely rotates the image bearing member by a distance that is greater than a distance from a position where the image bearing member and the cleaning blade make contact with each other to the upper surface position of the toner retained in the toner retention section, and is smaller than a distance from a position where the image bearing member and the cleaning blade make contact with each other to a position where the image bearing member and the toner retention roller make contact with each other.

Desirably, in the image forming apparatus, when a sliding distance of the cleaning blade on the image bearing member during the image formation process exceeds a predetermined distance, the control section stops the image formation process, and reversely rotates the image bearing member.

Desirably, the image forming apparatus further includes a drum unit including a photoconductor and a lubricant coater configured to apply lubricant to the photoconductor, wherein the image bearing member is an intermediate transfer member, and the control section reversely rotates the image bearing member when a use history of the drum unit satisfies a predetermined condition.

Desirably, in the image forming apparatus, the control section reversely rotates the image bearing member when an image formation mode during the image formation process satisfies a predetermined condition.

Desirably, in the image forming apparatus, the control section reversely rotates the image bearing member when an environment around the image forming apparatus satisfies a predetermined condition.

Desirably, in the image forming apparatus, the control section reversely rotates the image bearing member when a kind of a sheet used in the image formation process satisfies a predetermined condition.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment is described in detail with reference to the drawings.

[Configuration of Image Forming Apparatus 1]

Figure 1:
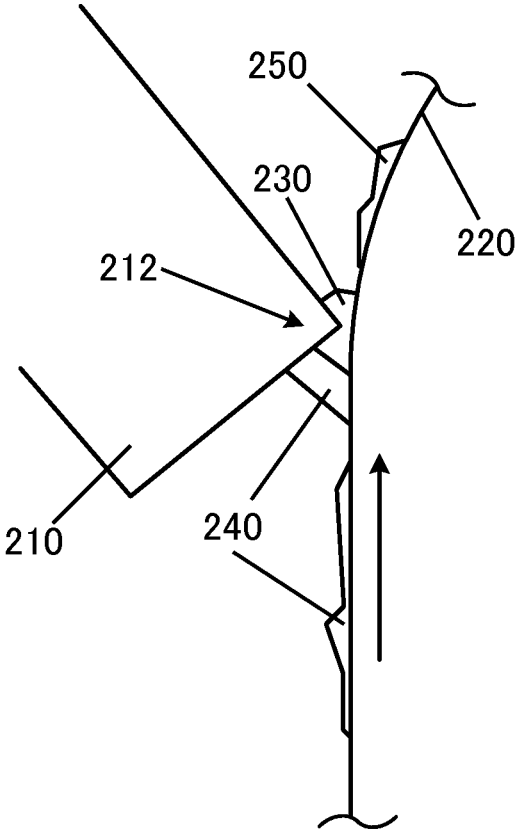
FIG. 1 illustrates a problem of the conventional technique.
Figure 2:
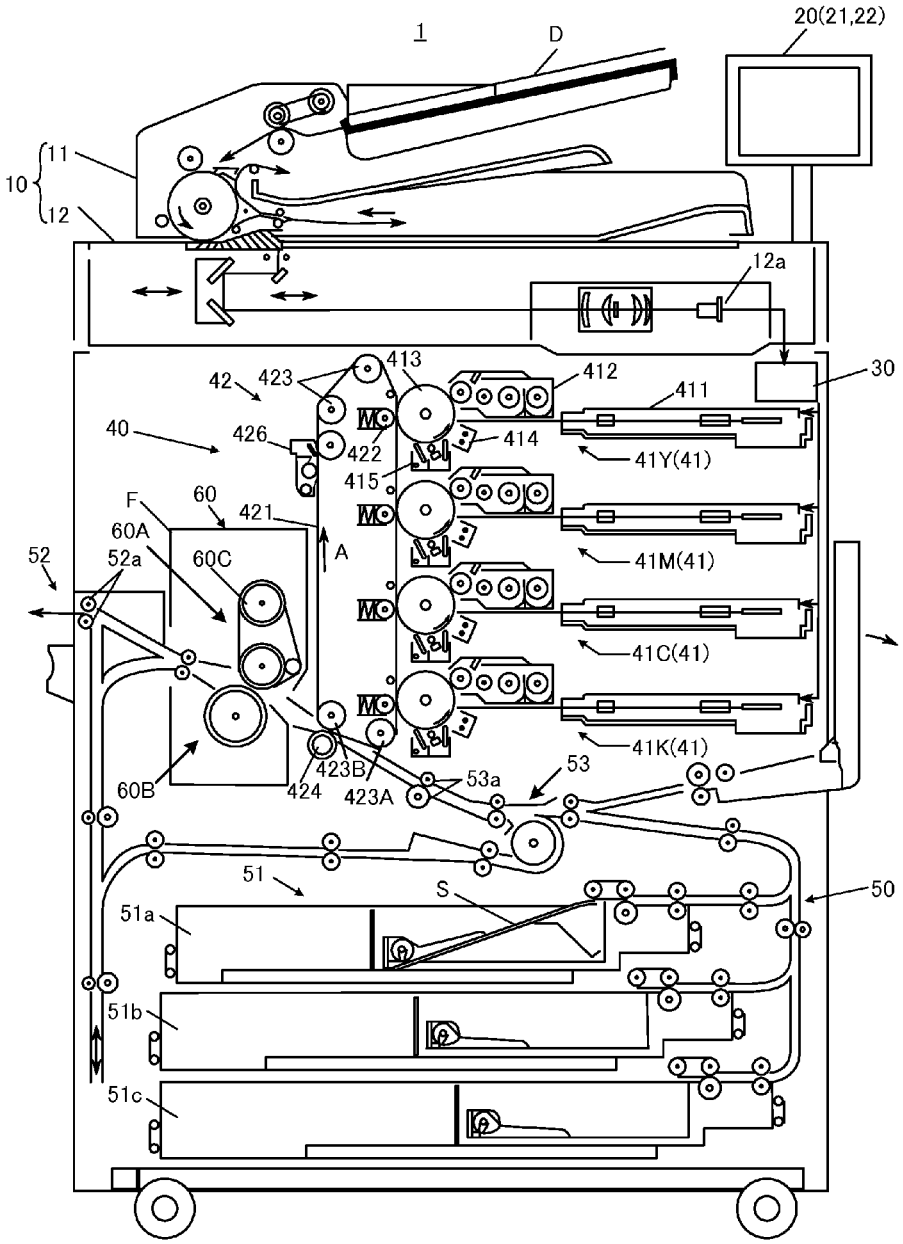
FIG. 2 schematically illustrates a general configuration of an image forming apparatus according to an embodiment.
Figure 3:
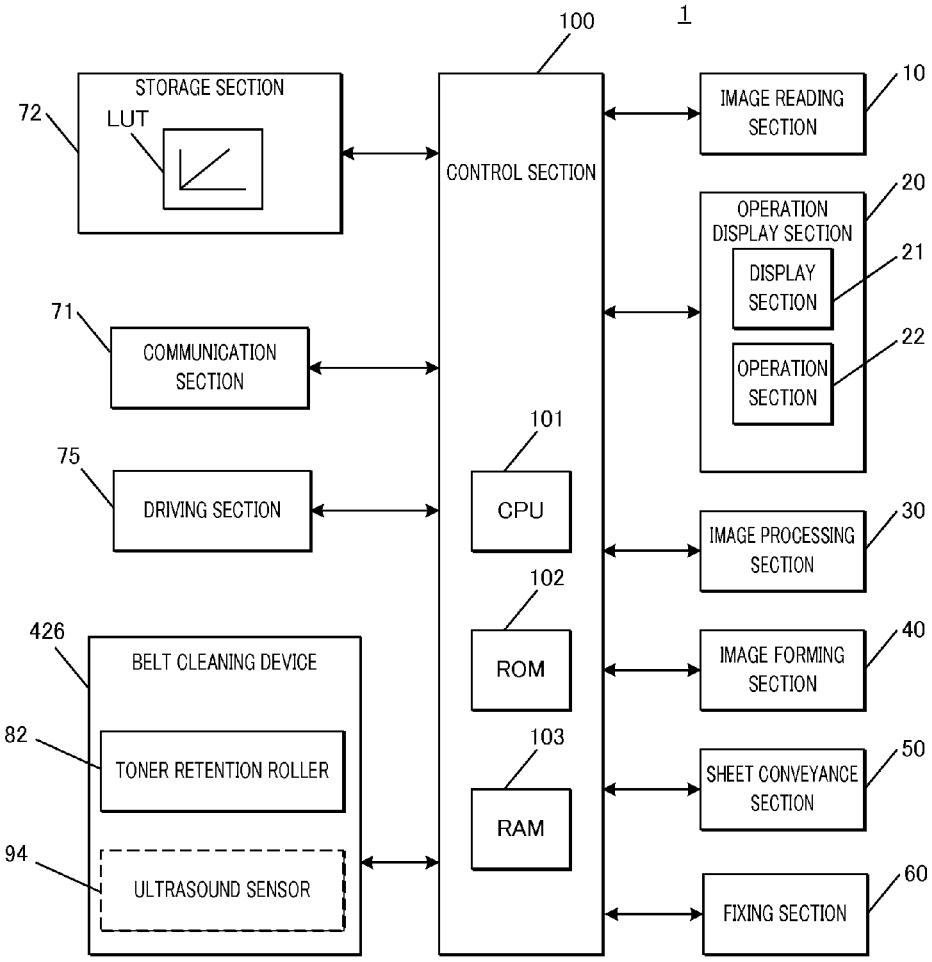
FIG. 3 illustrates a principal part of a control system of the image forming apparatus according to the embodiment.

FIG. 2 is a schematic view of an overall configuration of image forming apparatus 1 according to an embodiment of the present invention. FIG. 3 illustrates a principal part of a control system of image forming apparatus 1 according to the embodiment. Image forming apparatus 1 illustrated in FIGS. 2 and 3 is a color image forming apparatus with an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 3, image forming apparatus 1 includes image reading section 10, operation display section 20, image processing section 30, image forming section 40 (which corresponds to "toner supplying section" of the embodiment of the present invention), sheet conveyance section 50, fixing section 60, and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12.

Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 100. Operation section 22 includes various operation keys such as a numeric keypad and a start key, receives various input operations performed by a user, and outputs operation signals to control section 100.

Image processing section 30 includes a circuit that performs digital image processing suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm] The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 100 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. Since the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent images to form toner images.

Drum cleaning device 415 includes a drum cleaning blade that is brought into sliding contact with the surface of photoconductor drum 413, and removes residual toner that remains on the surface of photoconductor drum 413 after the primary transfer. A drum unit including photoconductor drum 413 (photoconductor) is provided with a lubricant coater that applies to photoconductor drum 413 lubricant in the form of powder which has been scraped by a lubricant application brush.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K component is a driving roller. With this configuration, the travelling speed of the belt at a primary transfer section can be easily maintained at a constant speed. When driving roller 423A rotates, intermediate transfer belt 421 travels in an arrow A direction at a constant speed.

Intermediate transfer belt 421 is a conductive belt which has a surface resistance of 8 to 12 (log Ω/□) and a volume resistivity of 7 to 11 [log Ω·cm]. Intermediate transfer belt 421 is rotationally driven with a control signal from control section 100. It is to be noted that the material, thickness and hardness of intermediate transfer belt 421 are not limited as long as intermediate transfer belt 421 has the above-mentioned conductivity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and electric charge of the polarity opposite to the polarity of the toner is applied to the rear side (the side that makes contact with secondary transfer roller 424) of sheet S, whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 (which corresponds to "image bearing member" of the embodiment of the present invention) after a secondary transfer. The specific configurations of belt cleaning device 426 will be described later. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing side member disposed on a fixing surface (the surface on which a toner image is formed) of sheet S, lower fixing section 60B having a back side supporting member disposed on the rear surface (the surface opposite to the fixing surface) side of sheet S, heating source 60C, and the like. Back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of registration rollers 53*a*.

The recording sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet discharging rollers 52*a*.

[Configuration of Main Part of Belt Cleaning Device 426]

Figure 4:
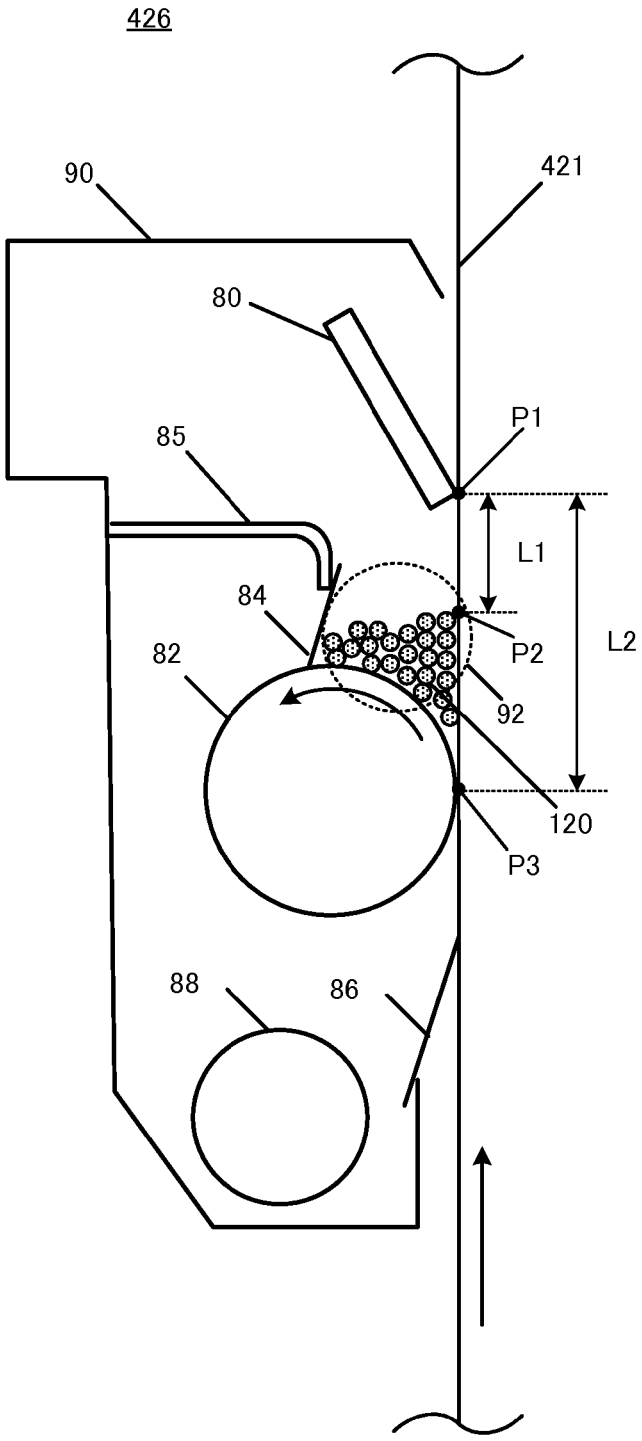
FIG. 4 illustrates a configuration of a main part of a belt cleaning device according to the embodiment.

Next, with reference to FIG. 4, the configuration of the main part of belt cleaning device 426 will be described. Belt cleaning device 426 includes cleaning blade 80, toner retention roller 82, toner ejection restriction member 84, toner scattering prevention member 86, toner collecting roller 88 and casing 90. Cleaning blade 80, toner retention roller 82, toner ejection restriction member 84, toner scattering prevention member 86 and toner collecting roller 88 are provided in casing 90.

Intermediate transfer belt 421 can be forwardly and reversely rotated by driving section 75 (for example, a motor) under the control of control section 100. During an image formation process of image forming apparatus 100 (when a printing job is executed), intermediate transfer belt 421 rotates at a predetermined rotation speed (for example, 460 [mm/s]) in the arrow direction in the drawing.

Cleaning blade 80 is attached to a supporting sheet metal (not illustrated) that supports cleaning blade 80. Cleaning blade 80 makes contact with the surface of intermediate transfer belt 421 to scrape off foreign matters including toner (aggregates of paper dust, external additive contained in toner, lubricant and the like) which remain on the surface of intermediate transfer belt 421.

Cleaning blade 80 brings its end portion (blade edge) into contact with the surface of intermediate transfer belt 421 in a counter direction with respect to the forward rotational direction of intermediate transfer belt 421 (the rotational direction during the image formation process). Cleaning blade 80 is made of an elastic material such as, but not limited to, a urethane rubber (hardness: 74 [degrees] and impact resilience coefficient: 23[%]), for example.

On the upstream side of cleaning blade 80 in the forward rotational direction of intermediate transfer belt 421, toner retention section 92 that temporarily retains toner 120 scraped by cleaning blade 80 (which is also referred to as "waste toner") is formed. Toner retention section 92 is a space defined by toner retention roller 82, toner ejection restriction member 84 and intermediate transfer belt 421. Along with the forward rotation of intermediate transfer belt 421, toner 120 retained in toner retention section 92 is conveyed toward cleaning blade 80, and the external additive contained in toner 120 is supplied to cleaning blade 80. In this manner, the sliding contact between cleaning blade 80 and intermediate transfer belt 421 is smoothened, and the damage of cleaning blade 80 due to excessive frictional force can be prevented.

Immediately after the shipment from the plant, or when belt cleaning device 426 has been replaced for a maintenance work, a solid image with a maximum printing width and a predetermined length is formed on intermediate transfer belt 421, and is conveyed to cleaning blade 80 without being transferred, and then, the image is removed. In this manner, a state where an appropriate amount of toner 120 is retained in toner retention section 92 is established. Thereafter, adequate transfer residual toner is generated by image formation, and thus a certain amount of toner 120 is always retained in toner retention section 92.

Toner ejection restriction member 84 is fixed with a double-sided tape or the like to holding member 85 that holds toner ejection restriction member 84. Toner ejection restriction member 84 is a flexible member made of polyethylene terephthalate (PET), for example. One end of toner ejection restriction member 84 hangs downward, and is in contact with the surface of toner retention roller 82. Toner retention roller 82 is tightly sandwiched between intermediate transfer belt 421 and toner ejection restriction member 84.

On the upstream side of contact position P1 where intermediate transfer belt 421 and cleaning blade 80 make contact with each other in the forward rotational direction of intermediate transfer belt 421, toner retention roller 82 is rotatably disposed in pressure contact with intermediate transfer belt 421. For example, a sponge roller, a rubber roller or a resin roller is applicable to toner retention roller 82. It is to be noted that toner retention roller 82 may be configured to be connected with a driving motor so as to be rotated separately from intermediate transfer belt 421, or may be configured to rotate along with travelling of intermediate transfer belt 421.

Toner 120 retained in toner retention section 92 passes through the gap between toner ejection restriction member 84 and toner retention roller 82 little by little along with the rotation of toner retention roller 82, and drops downward in casing 90. Toner 120 that has dropped downward in casing 90 is collected by toner collecting roller 88. Toner 120 that has been collected by toner collecting roller 88 is gathered in one place in belt cleaning device 426, and discarded.

In addition, toner retention section 92 has a configuration for forcibly ejecting toner 120 when the amount of toner 120 retained therein is increased. For example, toner retention section 92 may have a configuration in which toner 120 leaks from an opening (not illustrated) formed near the other end side (holding member 85 side) of toner ejection restriction member 84 when the volume of toner 120 is high. In addition, for example, toner retention section 92 may have such a configuration as a pressure-regulating valve in which the contact between toner ejection restriction member 84 and toner retention roller 82 is released by pressure so that toner 120 falls down when the amount of toner 120 retained therein exceeds a certain amount.

Toner scattering prevention member 86 is provided on the upstream side of toner retention roller 82 in the forward rotational direction of intermediate transfer belt 421, and is configured to prevent toner 120 sent from toner retention roller 82 to toner collecting roller 88 from leaking out of belt cleaning device 426.

Distance L1 from contact position P1 where intermediate transfer belt 421 and cleaning blade 80 make contact with each other to upper surface position P2 of toner 120 retained in toner retention section 92 in the rotational direction of intermediate transfer belt 421 is, for example, 8 [mm] In addition, distance L2 from contact position P1 where intermediate transfer belt 421 and cleaning blade 80 make contact with each other to contact position P3 where intermediate transfer belt 421 and toner retention roller 82 make contact with each other in the rotational direction of intermediate transfer belt 421 is, for example, 13 [mm].

Next, with reference to FIGS. 5A and 5B, foreign matter removing operation of image forming apparatus 1 will be described. The foreign matter removing operation is an operation for reversely rotating intermediate transfer belt 421 so as to remove foreign matter 140 which has sandwiched between the blade edge (end portion) of cleaning blade 80 and the surface of intermediate transfer belt 421 as the image formation process is continuously performed. This operation is performed after the rotation of intermediate transfer belt 421 is stopped, for example, after a printing job is performed.

Figure 5A:
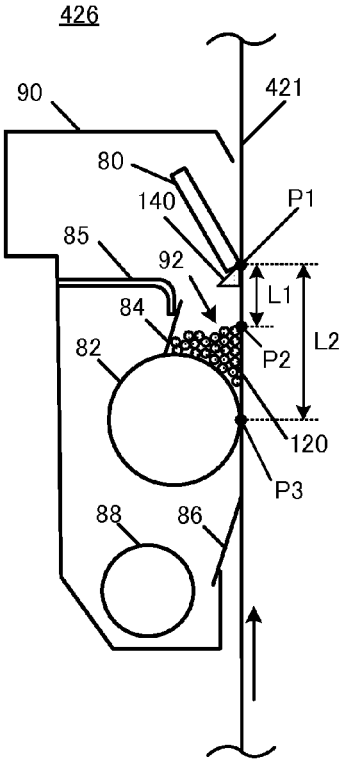
FIG. 5A illustrates a foreign matter removing operation in the image forming apparatus according to the embodiment.

FIG. 5A illustrates a state where foreign matter 140 is sandwiched between the blade edge of cleaning blade 80 and the surface of intermediate transfer belt 421. To remove foreign matter 140, in the present embodiment, control section 100 reversely rotates intermediate transfer belt 421 by a distance (for example, 9 [mm]) which is greater than distance L1 and smaller than distance L2. Here, distance L1 is a distance from contact position P1 where intermediate transfer belt 421 and cleaning blade 80 make contact with each other to upper surface position P2 of toner 120 retained in toner retention section 92, and distance L2 is a distance from contact position P1 where intermediate transfer belt 421 and cleaning blade 80 make contact with each other to contact position P3 where intermediate transfer belt 421 and toner retention roller 82 make contact with each other. It is to be noted that, in the present embodiment, the distance by which intermediate transfer belt 421 is reversely rotated is set to a value in the range of about 8 to 10 [mm] in consideration of a risk that the rotation of driving section 75 is varied.

Figure 5B:
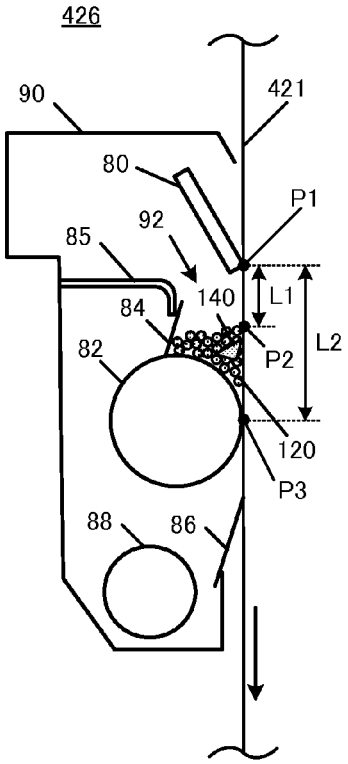
FIG. 5B illustrates the foreign matter removing operation in the image forming apparatus according to the embodiment.

FIG. 5B illustrates a state where intermediate transfer belt 421 has been reversely rotated. As illustrated in FIG. 5B, foreign matter 140 is took in toner 120 retained in toner retention section 92. Thus, it is possible to prevent foreign matter 140 from being again sandwiched between cleaning blade 80 and intermediate transfer belt 421 when intermediate transfer belt 421 is forwardly rotated afterward. Foreign matter 140 is kept in toner 120 retained in toner retention section 92, or is ejected together with toner 120 along with the rotation of toner retention roller 82.

In the case where the image formation process is successively performed (successive printing), foreign matter 140 is accumulated at the blade edge of cleaning blade 80. To remove such foreign matter 140, it is preferable to stop the image formation process and to reversely rotate intermediate transfer belt 421 when the sliding distance of cleaning blade 80 on intermediate transfer belt 421 exceeds a predetermined distance. For example, every time when the sliding distance of cleaning blade 80 on intermediate transfer belt 421 exceeds 100 [m], control section 100 forcibly stops the image formation process and reversely rotates intermediate transfer belt 421.

In addition, preferably, control section 100 reversely rotates intermediate transfer belt 421 when the use history of the drum unit including photoconductor drum 413 and a lubricant coater satisfies a predetermined condition. Foreign matter 140 due to paper dust tends to solidify when lubricant (zinc stearate) which is applied to photoconductor drum 413 to improve the cleaning performance of photoconductor drum 413 is mixed. When the drum unit is new, a lubricant application brush for scraping lubricant is also new and scrapes a large amount of the lubricant, and consequently, the amount of lubricant applied to photoconductor drum 413 is large, thus increasing the amount of lubricant transferred from photoconductor drum 413 to intermediate transfer belt 421. In addition, since the operation for reversely rotating intermediate transfer belt 421 undesirably removes a stopping layer on cleaning blade 80, reversely rotating intermediate transfer belt 421 to toner 120 retained in toner retention section 92 is not preferable in view of limiting abrasion of cleaning blade 80. Therefore, it is preferable to perform the operation for reversely rotating intermediate transfer belt 421 to toner 120 retained in toner retention section 92 after the printing job has been performed or at the time of successive printing, only when the drum unit is new. For example, after the travelling distance of photoconductor drum 413 exceeds 2000 [m], the amount of the reverse rotation of intermediate transfer belt 421 is set to about 2 [mm], and the image formation process is not forcibly stopped and intermediate transfer belt 421 is not reversely rotated to toner 120 retained in toner retention section 92 even at the time of successive printing. In this manner, abrasion of cleaning blade 80 due to excessive reverse rotation can be reduced.

In addition, preferably, control section 100 reversely rotates intermediate transfer belt 421 to toner 120 retained in toner retention section 92 when an image formation mode during the image formation process satisfies a predetermined condition. When the image formation mode is the monochrome mode, only the drum unit for black operates, and the amount of lubricant transferred from photoconductor drum 413 to intermediate transfer belt 421 is ¼ in comparison with the case where the image formation mode is the full color mode. Therefore, only when the image formation mode is the full color mode, control section 100 reversely rotates intermediate transfer belt 421. Thus, abrasion of cleaning blade 80 due to excessive reverse rotation can be reduced.

In addition, preferably, control section 100 reversely rotates intermediate transfer belt 421 to toner 120 retained in toner retention section 92 when the environment around image forming apparatus 1 satisfies a predetermined condition. The amount of lubricant transferred from photoconductor drum 413 to intermediate transfer belt 421 varies depending on the environment around image forming apparatus 1.

For example, in a normal-temperature, low-humidity environment or in a low-temperature, low-humidity environment, the lubricant application brush is hardened and consequently the amount of lubricant transferred to intermediate transfer belt 421 increases. On the other hand, in a high-temperature, high-humidity environment, the lubricant application brush is softened, and the amount of lubricant transferred to intermediate transfer belt 421 decreases. Therefore, control section 100 refers to detection results of a temperature-and-humidity sensor provided around image forming apparatus 1, and, only when the environment around image forming apparatus 1 is a normal-temperature, low-humidity environment or a low-temperature, low-humidity environment, reversely rotates intermediate transfer belt 421 to toner 120 retained in toner retention section 92. Thus, abrasion of cleaning blade 80 due to excessive reverse rotation can be reduced.

In addition, preferably, control section 100 reversely rotates intermediate transfer belt 421 to toner 120 retained in toner retention section 92 when the kind of sheet used for the image formation process satisfies a predetermined condition. The paper dust is generated when filler (inorganic pigment applied to a sheet to increase the smoothness, whiteness, printing performance and the like of the sheet) is detached from the sheet. Therefore, a coated paper which does not tend to generate paper dust does not tend to generate foreign matter 140 which causes cleaning defects. In view of this, control section 100 reversely rotates intermediate transfer belt 421 to toner 120 retained in toner retention section 92 only when the kind of sheet used for the image formation process is non-coated paper such as plain paper and high quality paper. Thus, abrasion of cleaning blade 80 due to excessive reverse rotation can be reduced.

[Effect of the Present Embodiment]

As has been described in detail, in the present embodiment, image forming apparatus 1 includes intermediate transfer belt 421, cleaning blade 80, toner retention section 92, driving section 75, and control section 100. Specifically, intermediate transfer belt 421 is forwardly and reversely rotatable. Cleaning blade 80 makes contact with intermediate transfer belt 421 and scrapes toner remaining on intermediate transfer belt 421. Toner retention section 92 is formed on the upstream side of cleaning blade 80 in the forward rotational direction of intermediate transfer belt 421 and retains toner 120 scraped by cleaning blade 80. Driving section 75 rotationally drives intermediate transfer belt 421. Control section 100 reversely rotates intermediate transfer belt 421 by a distance which is greater than distance L1 and smaller than distance L2. Here, distance L1 is a distance from contact position P1 where intermediate transfer belt 421 and cleaning blade 80 make contact with each other to upper surface position P2 of toner 120 retained in toner retention section 92, and distance L2 is a distance from contact position P1 where intermediate transfer belt 421 and cleaning blade 80 make contact with each other to contact position P3 where intermediate transfer belt 421 and toner retention roller 82 make contact with each other.

According to the above-mentioned configuration of the present embodiment, foreign matter 140 sandwiched between cleaning blade 80 and intermediate transfer belt 421 is moved to toner retention section 92 by the reverse rotation of intermediate transfer belt 421, and is took in toner 120 toner retention section 92. Thus, it is possible to prevent foreign matter 140 from being again sandwiched between cleaning blade 80 and intermediate transfer belt 421 when intermediate transfer belt 421 is forwardly rotated afterward. Thus, cleaning defect can be surely prevented.

[Modification]

While intermediate transfer belt 421 corresponds to the "image bearing member" of the embodiment of the present invention in the above-mentioned embodiment, the present invention is not limited to this. For example, photoconductor drum 413 may correspond to the "image bearing member" of the embodiment of the present invention. In addition, when image forming apparatus 1 includes a secondary transfer belt configured to transfer toner on intermediate transfer belt 421 to a sheet, the secondary transfer belt may correspond to the "image bearing member" of the embodiment of the present invention.

In addition, in the above-mentioned embodiment, it is also possible to control image forming section 40 to form on intermediate transfer belt 421 a toner band (which is also referred to as "patch image") to be supplied to cleaning blade 80 such that the upper surface position of toner 120 retained in toner retention section 92 is set to a predetermined upper surface position P2. The predetermined upper surface position P2 is an upper surface position which is set in advance and at which cleaning blade 80 is not immersed in toner 120 retained in toner retention section 92. Image forming section 40 forms the toner band at, for example, a time interval of sheets (when image formation is not carried out) in the case where images are successively formed. In particular, when images with a low coverage rate are successively formed, the amount of the resulting transfer residual toner is small, and consequently the amount of toner retained in toner retention section 92 decreases. For this reason, control section 100 monitors the coverage rate of the image to be formed, and supplies a toner band to cleaning blade 80 as necessary.

In the above-mentioned embodiment, an example has been described in which, in the foreign matter removing operation of image forming apparatus 1, intermediate transfer belt 421 is reversely rotated by a distance which is greater than distance L1 and smaller than distance L2. Here, distance L1 is a distance from contact position P1 where intermediate transfer belt 421 and cleaning blade 80 make contact with each other to upper surface position P2 of toner 120 retained in toner retention section 92, and distance L2 is a distance from contact position P1 where intermediate transfer belt 421 and cleaning blade 80 make contact with each other to contact position P3 where intermediate transfer belt 421 and toner retention roller 82 make contact with each other. The present invention is not limited to this example. In short, since it is only necessary that foreign matter 140 is moved to toner 120 retained in toner retention section 92, intermediate transfer belt 421 only has to be reversely rotated by a distance greater than distance L1. Given, however, that the more intermediate transfer belt 421 is reversely rotated, the more abrasion of cleaning blade 80 is caused, it is preferable that intermediate transfer belt 421 be reversely rotated by a distance which is greater than distance L1 and smaller than distance L2.

Figure 6:
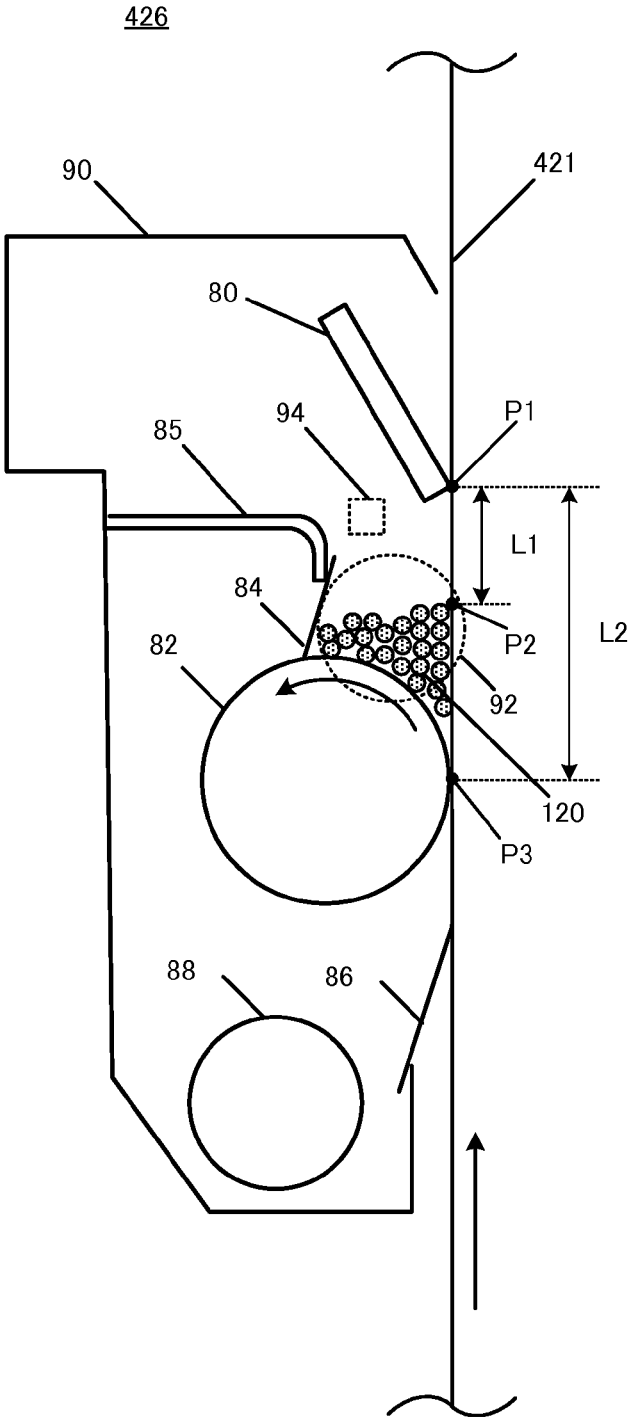
FIG. 6 illustrates a modification of a configuration of a main part of the belt cleaning device according to the embodiment.

In addition, in the above-mentioned embodiment, an example has been described in which control section 100 controls image forming section 40 such that the upper surface position of toner 120 retained in toner retention section 92 is set to the predetermined upper surface position P2, and intermediate transfer belt 421 is reversely rotated by a distance greater than the distance from contact position P1 where intermediate transfer belt 421 and cleaning blade 80 make contact with each other to the predetermined upper surface position P2. The present invention is not limited to this example. For example, it is also possible to adopt a configuration in which a detection section that detects the upper surface position of toner 120 retained in toner retention section 92 is provided, and control section 100 reversely rotates intermediate transfer belt 421 by a distance greater than distance L1 from contact position P1 where intermediate transfer belt 421 and cleaning blade 80 make contact with each other to upper surface position P2 detected by the detection section. FIG. 6 illustrates a configuration in which belt cleaning device 426 includes, for example, ultrasound sensor 94 serving as the detection section. Ultrasound sensor 94 is provided above toner retention section 92. Ultrasound sensor 94 irradiates toner 120 retained in toner retention section 92 with ultrasound waves, and computes upper surface position P2 on the basis of the time it takes before the reflected waves are received. This configuration makes it unnecessary to perform the operation for forming the toner band to be supplied to cleaning blade 80 on intermediate transfer belt 421 such that the upper surface position of toner 120 retained in toner retention section 92 is set to the predetermined upper surface position P2. It is to be noted that, in place of ultrasound sensor 94, a light sensor including a light emitting section that irradiates toner 120 with light and a light receiving section that receives the light reflected from toner 120 may be employed as a detection section that detects the upper surface position of toner 120. In this case, the upper surface position of toner 120 is computed on the basis of the result obtained by the light receiving section. In addition, it is also possible to indirectly compute the upper surface position of toner 120 retained in toner retention section 92 by determining the amount of toner 120 sent from toner retention roller 82 to toner collecting roller 88. In this case, as the amount of toner 120 sent to toner collecting roller 88 increases, the upper surface position of toner 120 retained in toner retention section 92 comes closer to contact position P1 where intermediate transfer belt 421 and cleaning blade 80 make contact with each other.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

What is claimed is:

1. An image forming apparatus comprising:

an image bearing member configured to be forwardly and reversely rotatable;

a cleaning blade configured to make contact with the image bearing member and scrape toner remaining on the image bearing member;

a toner retention section defined on an upstream side of the cleaning blade in a forward rotational direction of the image bearing member, the toner retention section being configured to retain toner scraped by the cleaning blade;

a driving section configured to rotationally drive the image bearing member;

a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed;

and a toner supplying section configured to supply toner to the image bearing member;

wherein the control section controls the toner supplying section such that the upper surface position of the toner retained in the toner retention section is set to a predetermined upper surface position.

2. The image forming apparatus according to claim 1, further comprising a detection section configured to detect the upper surface position of the toner retained in the toner retention section, wherein the control section computes a distance to the upper surface position on the basis of a detection result of the detection section.

3. An image forming apparatus comprising:

an image bearing member configured to be forwardly and reversely rotatable;

a cleaning blade configured to make contact with the image bearing member and scrape toner remaining on the image bearing member;

a toner retention section defined on an upstream side of the cleaning blade in a forward rotational direction of the image bearing member, the toner retention section being configured to retain toner scraped by the cleaning blade;

a driving section configured to rotationally drive the image bearing member;

a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed;

and a toner retention roller configured to make contact with the image bearing member, the toner retention roller defining the toner retention section together with the image bearing member; wherein the control section reversely rotates the image bearing member by a distance that is greater than a distance from a position where the image bearing member and the cleaning blade make contact with each other to the upper surface position of the toner retained in the toner retention section, and is smaller than a distance from a position where the image bearing member and the cleaning blade make contact with each other to a position where the image bearing member and the toner retention roller make contact with each other.

4. The image forming apparatus according to claim 1, wherein, when a sliding distance of the cleaning blade on the image bearing member during the image formation process exceeds a predetermined distance, the control section stops the image formation process, and reversely rotates the image bearing member.

5. An image forming apparatus comprising:

an image bearing member configured to be forwardly and reversely rotatable;

a cleaning blade configured to make contact with the image bearing member and scrape toner remaining on the image bearing member;

a toner retention section defined on an upstream side of the cleaning blade in a forward rotational direction of the image bearing member, the toner retention section being configured to retain toner scraped by the cleaning blade;

a driving section configured to rotationally drive the image bearing member;

a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed;

and a drum unit including a photoconductor and a lubricant coater configured to apply lubricant to the photoconductor; wherein the image bearing member is an intermediate transfer member, and the control section reversely rotates the image bearing member when a use history of the drum unit satisfies a predetermined condition.

6. The image forming apparatus according to claim 1, wherein the control section reversely rotates the image bearing member when an image formation mode during the image formation process satisfies a predetermined condition.

7. An image forming apparatus comprising:

an image bearing member configured to be forwardly and reversely rotatable;

a cleaning blade configured to make contact with the image bearing member and scrape toner remaining on the image bearing member;

a toner retention section defined on an upstream side of the cleaning blade in a forward rotational direction of the image bearing member, the toner retention section being configured to retain toner scraped by the cleaning blade;

a driving section configured to rotationally drive the image bearing member;

and a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed;

wherein the control section reversely rotates the image bearing member when an environment around the image forming apparatus satisfies a predetermined condition.

8. An image forming apparatus comprising:

an image bearing member configured to be forwardly and reversely rotatable;

a cleaning blade configured to make contact with the image bearing member and scrape toner remaining on the image bearing member;

a toner retention section defined on an upstream side of the cleaning blade in a forward rotational direction of the image bearing member, the toner retention section being configured to retain toner scraped by the cleaning blade;

a driving section configured to rotationally drive the image bearing member;

and a control section configured to control the driving section to reversely rotate the image bearing member by a distance greater than a distance from a position where the image bearing member and the cleaning blade make contact with each other to an upper surface position of toner retained in the toner retention section, at a time when an image formation process is not performed;

wherein the control section reversely rotates the image bearing member when a kind of a sheet used in the image formation process satisfies a predetermined condition.

* * * * *